United States Patent [19]

Tolar

[11] 4,382,595

[45] May 10, 1983

[54] SWING SEAT ADAPTER

[76] Inventor: Barbara D. Tolar, 27 Sacramento Dr. Apt. 27, Hampton, Va. 23666

[21] Appl. No.: 207,065

[22] Filed: Nov. 14, 1980

[51] Int. Cl.[3] ..... A63G 9/00

[52] U.S. Cl. ..... 272/85; 297/275

[58] Field of Search ..... 272/33 R, 33 A, 49, 272/52, 52.5, 54, 55, 70.3, 85–92; 297/42, 44, 45, 152, 216, 230, 231, 250, 254, 273–282, 464, 465, 486–488

[56] References Cited

U.S. PATENT DOCUMENTS

| | | | |
|---|---|---|---|
| 132,021 | 10/1872 | Prescott | 297/275 |
| 959,085 | 5/1910 | Virgie | 297/273 X |
| 1,503,493 | 8/1924 | Eiffe | 297/273 |
| 1,603,578 | 10/1926 | Biernat | 297/273 X |
| 2,464,513 | 3/1949 | Johnson | 297/152 X |
| 2,555,566 | 6/1951 | Bleck | 297/152 |
| 3,256,016 | 6/1966 | Berlin | 272/85 |
| 3,722,883 | 3/1973 | O'Dowd | 272/85 |
| 4,093,208 | 6/1978 | Tomalinas | 272/52.5 |

FOREIGN PATENT DOCUMENTS

| | | | |
|---|---|---|---|
| 216933 | 6/1924 | United Kingdom | 297/275 |

*Primary Examiner*—Richard C. Pinkham
*Assistant Examiner*—S. R. Crow
*Attorney, Agent, or Firm*—Harvey B. Jacobson

[57] ABSTRACT

A child receiving structure including a pair of laterally spaced upstanding sides is provided. The sides include upstanding front and rear marginal portions and are interconnected by an upstanding transverse rear wall extending and connected therebetween. The child receiving structure is positionable on the elongated horizontal transverse seat of a swing suspended at its opposite ends from the lower ends of dependingly supported suspension members and coupling structure is removably operatively connected between the upper portion of the sides and adjacent portions of the suspension members spaced above the seat for preventing the seat from excessive forward or rearward tilting. Further, an occupant restraining harness is provided in the child receiving structure for releasably securing a child therein.

12 Claims, 7 Drawing Figures

3
10
16
16
28
34
70
52
22
18
72
14
54
12
38
36
3

34
57
18
60
62
28
62
50
50
52
36
44
48
26
76
52
20
78
54
24
74
74
76
78

16
16
34
18
57
5
5
58
58
22
32
12
30
20
14
14
74
54
74

SWING SEAT ADAPTER

BACKGROUND OF THE INVENTION

Substantially all playgrounds and recreation areas include swings for children, but many children, either because of young age or physical and/or metal handicaps, are unable to use a swing with safety. Accordingly, a need exists for a structure whereby a young child or mentally and/or physical disabled child may be supported from a swing seat in a safe manner against falling therefrom during use of the swing.

Although safety seats for use in conjunction with swing structures and other devices heretofore have been provided such as those disclosed in U.S. Pat. Nos. 1,823,318, 3,298,738, 3,722,883, 3,830,491, 3,897,056 and 4,175,786, many of these safety devices are not specifically adapted for use in conjunction with swing seats and those which are usable in conjunction with swing seats include structural and operational disadvantages.

BRIEF DESCRIPTION OF THE INVENTION

The swing seat adapter structure of the instant invention is constructed in a manner whereby it may be readily utilized in conjunction with substantially all playground and recreational swing seats. The adapter is further constructed in a manner whereby a young child or physical and/or mentally handicapped child may be safely contained therein while using a swing. The adapter structure includes anchor structure for securely fastening the child receiving structure to an associated swing seat and for securely restraining a child therein.

The main object of this invention is to provide a swing seat adapter which may be utilized for containing children and which will function in a manner to securely restrain children in comfortable positions on a conventional swing seat.

Another object of this invention is to provide a swing seat adapter which may be readily removably mounted on conventional swing seats.

Still another object of this invention is to provide a swing seat adapter in accordance with the preceding objects and which may be constructed in a manner to receive children therein of different sizes.

A final object of this invention to be specifically enumerated herein is to provide a swing seat adapter in accordance with the preceding objects and which will conform to conventional forms of manufacture, be of simple construction and easy to use so as to provide a device that will be economically feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
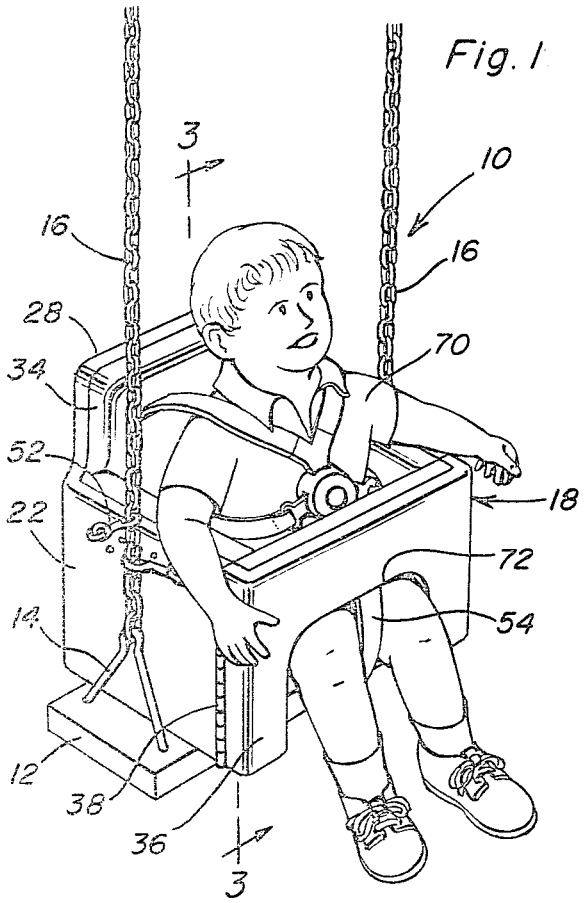
FIG. 1 is a perspective view of the lower seat portion of a swing with the adapter of the instant invention operatively associated with the swing seat and with a small child operatively restrained within the adapter.
Figure 2:
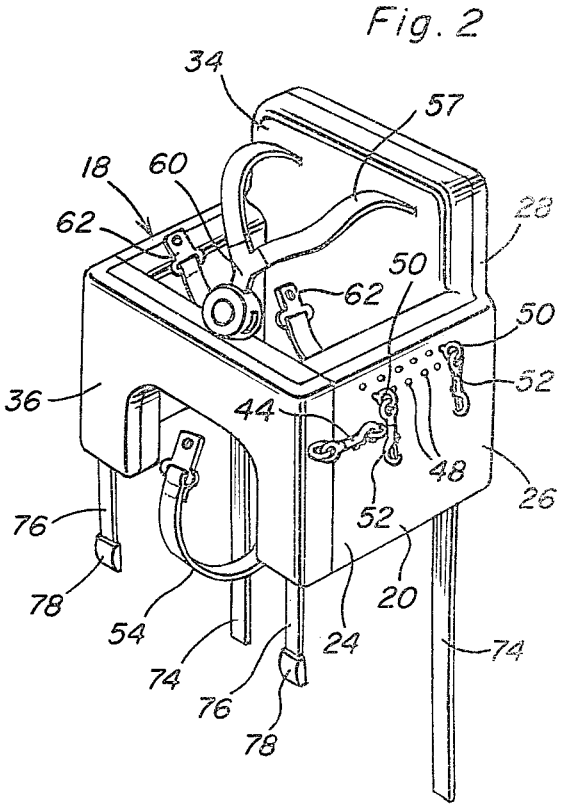
FIG. 2 is a perspective view of the adapter.
Figure 4:
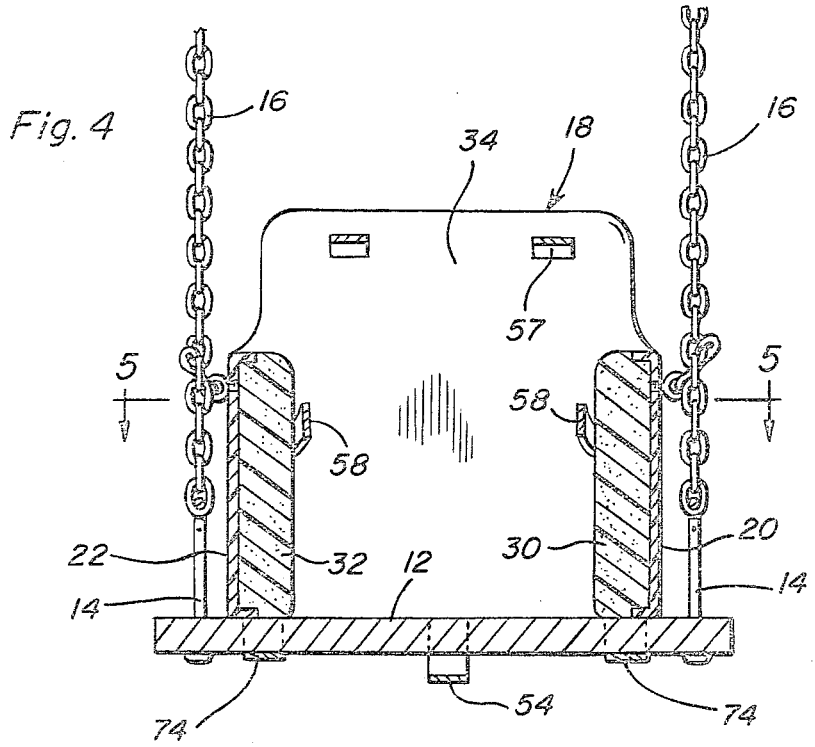
FIG. 4 is a vertical sectional view taken substantially upon the plane indicated by the section line 4—4 of FIG. 3.
Figure 3:
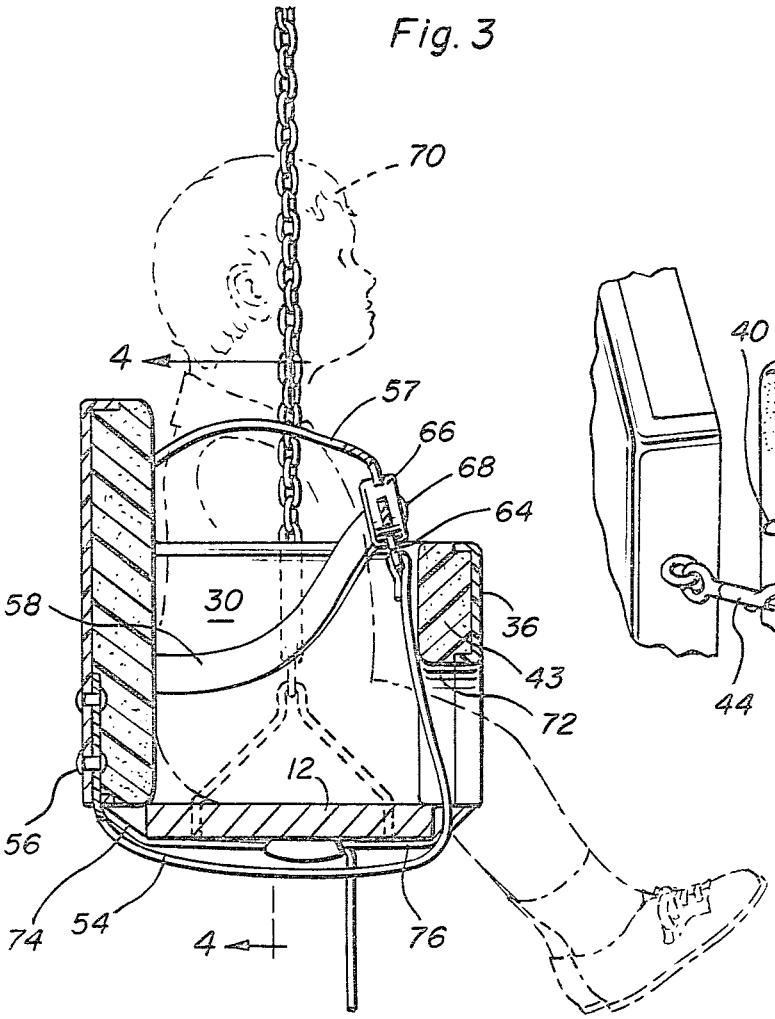
FIG. 3 is an enlarged fragmentary vertical sectional view taken substantially upon the plane indicated by the section line 3—3 of FIG. 1.
Figure 6:
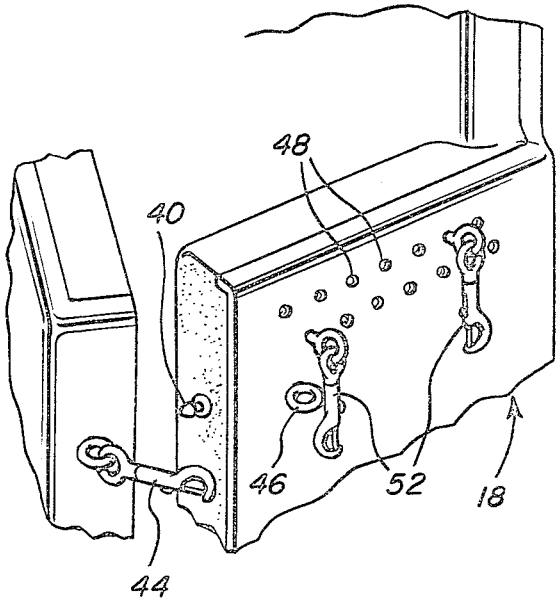
FIG. 6 is a fragmentary enlarged perspective view of the seat adapter with the front wall thereof in a partially open position illustrating the front wall lock structure and portions of the front wall latch structure.
Figure 7:
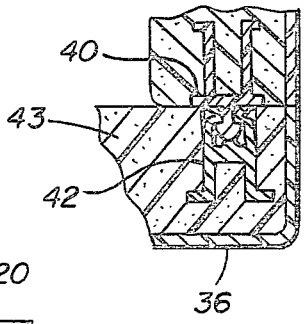
FIG. 7 is a fragmentary enlarged horizontal sectional view illustrating the front wall latch structure of the seat adapter.
Figure 5:
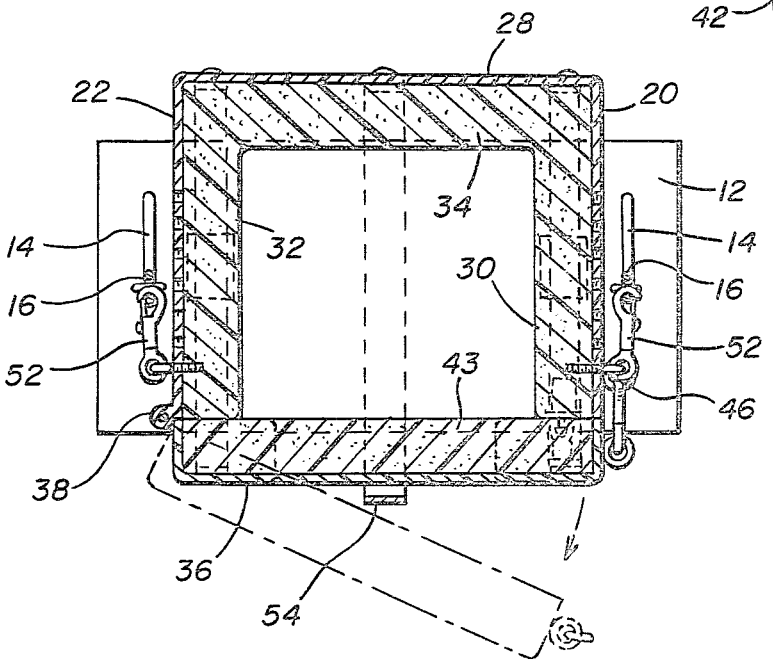
FIG. 5 is a horizontal sectional view taken substantially upon the plane indicated by the section line 5—5 of FIG. 4.

Referring now more specifically to the drawings, the numeral 10 generally designates a conventional form of swing including a horizontal elongated seat 12 whose opposite ends include upstanding inverted V-shaped anchor members 14 having the lower ends of a pair of dependingly supported suspension members 16 anchored thereto. The suspension members 16 may comprise ropes, cables or chains (as illustrated).

The seat adapter of the instant invention is referred to in general by the reference numeral 18 and includes a pair of laterally spaced upstanding sides 20 and 22 having front and rear marginal portions 24 and 26. An upstanding rear wall 28 extends between and interconnects the rear marginal portions 26 of the sides 20 and 22 and is formed integrally with the sides.The interior surfaces of the sides 20 and 22 and the rear wall 28 include inner side cushion panels 30, 32 and 34 and the forward marginal portions 24 of the sides 20 and 22 are releasably interconnected by an upstanding front wall 36 extending therebetween. The right-hand side of the front wall 36 is hingedly supported from the forward marginal portion 24 of the side 22 by a vertically extending hinge 38 and the forward marginal portion 24 of the side 20 includes a latch structure 40 releasably engageable with a keeper structure 42 carried by the left-hand side of the front wall 36 whereby the front wall 36 may be releasably retained in a closed position extending between the forward marginal portions 24 of the sides 20 and 22.

The front wall 36 includes an inner side cushion panel 43 similar to the panels 30, 32 and 34 and a latching type anchor hook 44 is swivelly supported from the left-hand side of the front wall 36 and is releasably engageable with an anchor eye 46 carried by the side 20.

The sides 20 and 22 are each provided with a plurality of front to rear and vertically spaced threaded bores 48 and a pair of anchor eyes 50 are removably threadedly engaged in one pair of bores 48 on each side 20 and 22 and have latching anchor hooks 52 universally supported therefrom. The anchor hooks 52 are releasably engageable with portions of the suspension member 16 spaced above the anchor member 14. It will be noted that each pair of anchor hooks 52 are mounted on the sides 20 and 22 in position spaced forward and rearward of the corresponding suspension member 16, and that each pair of anchor hooks 52 is latching engaged with the vertically spaced portions of the corresponding suspension member 16.

The lower central portion of the rear wall 28 has one end of a first anchor strap 54 anchored relative thereto as at 56 and the upper marginal portion of the rear wall 28 has the free arm ends of a V-shaped anchor strap 57 anchored relative thereto. Further, the rear marginal portions of the sides 20 and 22 have one pair of corresponding ends of a pair of opposite side straps 58 anchored relative thereto.

The apex portion 60 of the anchor strap 57, the other pair of corresponding ends 62 of the opposite side straps and the end 64 of the anchor strap 54 comprise end anchor tabs releasably engageable with a multi socket anchor structure 66 under the control of a release button 68. Accordingly, it may be seen that the various straps 54, 57 and 58 may be utilized to securely removably restrain a child 70 within the seat adapter 18. It will be noted that the anchor strap 54 passes beneath the swing seat 12 and upward between the legs of the child 70. Further, it may also be seen that the central lower marginal portion of the front wall 36 includes a large downwardly opening notch 72 therein for receiving the legs of the child 70 therethrough.

Further, first and second straps 74 and 76 are carried by the right-hand and left-hand lower marginal portions of the rear wall 28 and front wall 36. The free ends of the straps 76 include buckles 78 with which the free ends of the straps 74 are releasably engageable. In this manner, the straps 74 and 76 may be passed beneath the seat 12 and anchored relative to each other to further assist in maintaining the seat adapter 18 in proper position on the seat 12.

Various types of swings use different types of suspension members and inverted V-shaped anchor members (either rigid of flexible) similar to the anchor members 14 which are of considerably greater vertical height than the anchor members 14. The pair of anchor hooks 52 provided on each side 20 enables the seat adapter to be readily operatively connected to such vertically elongated inverted V-shaped anchor members.

In operation, when the straps 56, and 58 are released from the anchor structure 66, the front wall 36 of the seat adapter 18 may be unlocked and swung to the open position. Thereafter, the child 70 may be placed within the seat adapter 18 and the front wall 36 may be closed and locked in the closed position. Thereafter, the various free ends of the straps 56, and 58 may be releasably anchored to the anchor structure 66. Of course, the anchor structure 18 is initially secured to the swing seat 12 through utilization of the straps 74 and 76 and the anchor hooks 52.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a swing of the type including an elongated horizontal transverse seat suspended at its opposite ends from the lower ends of a single pair of dependingly supported suspension members including anchor means at their lower ends anchored to said seat ends, an adapter for said seat including front, rear and opposite side marginal portions and incorporating a pair of laterally spaced upstanding sides extending between said front and rear marginal portions, an upstanding transverse rear wall structure extending and secured between the rear marginal portions of said sides, said adapter being downwardly and removably seated upon said seat between the lower ends of said suspension members, retaining means operatively removably coupled between upper portions of said sides and adjacent portions of said suspension members spaced above said seat and above said anchor means for preventing the seat from excessive forward or rearward tilting, and occupant restraining harness structure carried by said adapter operative to releasably secure a child within said adapter and seated on said seat.

2. The combination of claim 1 including an upstanding front wall, one side edge of said front wall being hingedly supported from the forward marginal portion of one of said sides and the other side edge of said front wall and the forward marginal edge portion of the other side including releasable latch structure for securing front wall in a closed position extending between the forward marginal portions of said sides, said front wall having a central downwardly opening notch formed therein for receiving the legs of a child disposed within said adapter therethrough.

3. The combination of claim 2 wherein at least major portions of the inner surfaces of said sides and said rear wall structure and front wall include impact cushion panels secured thereover.

4. The combination of claim 1 wherein said retaining means comprises two pairs of opposite side latching type anchor hooks universally supported from said sides and removably latchingly engaged with said suspension members.

5. The combination of claim 1 wherein said occupant restraining harness structure includes a V-shaped anchor structure having the free arm ends thereof anchored relative to upper opposite side marginal portions of said rear wall structure and an anchor strap having one end anchored relative to the lower marginal portion of said rear wall structure and passing forwardly beneath said swing seat, the other end of the last mentioned anchor strap and the apex portion of the first mentioned anchor strap being removably coupled together with the second mentioned anchor strap being adapted to pass upwardly between the legs of a child disposed in said adapter.

6. The combination of claim 1 including opposite side strap portions carried by said adapter, extending between said front and rear marginal portions of said adapter and passing beneath the opposite ends of said swing seat.

7. The combination of claim 6 wherein said occupant restraining harness structure includes a V-shaped anchor structure having the free arm ends thereof anchored relative to upper opposite side marginal portions of said rear wall structure and an anchor strap having one end anchored relative to the lower marginal portion of said rear wall structure and passing forwardly beneath said swing seat, the other end of the last mentioned anchor strap and the apex portion of the first mentioned anchor strap being removably coupled together with the second mentioned anchor strap being adapted to pass upwardly between the legs of a child disposed in said adapter.

8. The combination of claim 7 wherein said retaining means comprises two pairs of opposite side latching type anchor hooks universally supported from said sides and removably latchingly engaged with said suspension members.

9. The combination of claim 8 including an upstanding front wall, one side edge of said front wall being hingedly supported from the forward marginal portion of one of said sides and the other side edge of said front wall and the forward marginal edge portion of the other side including releasable latch structure for securing front wall in a closed position extending between the forward marginal portions of said sides, said front wall having a central downwardly opening notch formed therein for receiving the legs of a child disposed within said adapter therethrough.

10. The combination of claim 9 wherein at least major portions of the inner surfaces of said sides and said rear wall structure and front wall include impact cushion panels secured thereover.

11. The combination of claim 1 wherein said adapter is devoid of a bottom wall structure extending between the lower marginal edges of said sides and the occupant of said seat adapter is receivable between said sides forward of said rear wall and in a seated position directly upon said swing seat.

12. The combination of claim 11 including an upstanding front wall, one side edge of said front wall being hingedly supported from the forward marginal portion of one of said sides and the other side edge of said front wall and the forward marginal edge portion of the other side including releasable latch structure for securing front wall in a closed position extending between the forward marginal portions of said sides, said front wall having a central downwardly opening notch formed therein for receiving the legs of a child disposed within said adapter therethrough.

* * * * *